United States Patent [19]

Green et al.

[11] 4,359,614

[45] Nov. 16, 1982

[54] MINIATURE TWO-LEVEL PUSHBUTTON SWITCH

[75] Inventors: Todd C. Green, Chicago; Bruce L. Graham, Wheeling, both of Ill.

[73] Assignee: Illinois Tool Works Inc., Chicago, Ill.

[21] Appl. No.: 305,064

[22] Filed: Sep. 24, 1981

[51] Int. Cl.[3] ..... H01H 13/64; H01H 13/48

[52] U.S. Cl. ..... 200/5 R; 200/1 B; 200/67 DA; 200/159 A

[58] Field of Search ..... 200/159 A, 159 B, 283, 200/67 DB, 67 DA, 5 A, 5 B, 1 B, 159 R

[56] References Cited

U.S. PATENT DOCUMENTS

| | | | |
|---|---|---|---|
| 2,109,184 | 2/1938 | Sereda | 200/159 A |
| 2,262,777 | 11/1941 | Roper | 200/159 B |
| 2,317,727 | 4/1943 | Bonanno | 200/1 B |
| 3,996,429 | 12/1976 | Chu et al. | 200/159 A |
| 4,146,767 | 3/1979 | Murata | 200/159 B |
| 4,195,210 | 3/1980 | Pounds et al. | 200/159 A |

*Primary Examiner*—John W. Shepperd
*Attorney, Agent, or Firm*—Donald D. Mondul; Thomas W. Buckman

[57] ABSTRACT

A miniature, two-level pushbutton switch comprises a base for mounting a plurality of relatively movable electrical contacts and a plurality of relatively fixed electrical terminals. The base includes at least one support surface for supporting the contacts and terminals. A pushbutton is mounted to the base for reciprocal movement along a predetermined straight line. The contacts include an elongate contact bar having at least one flat contact surface mounted for movement in response to actuation of the pushbutton in a first direction and a contact dome having at least one flat contact surface normally spaced apart from the contact surface of the contact bar when the pushbutton is in an unactuated condition. The terminals include a first terminal including a gripping portion for holding the contact bar in assembled condition with the base while achieving electrical contact with the contact bar. A second terminal includes a gripping portion engaging the base and an extension which urges the contact dome against the base support surface, thereby holding the contact dome in assembled condition with the base while achieving electrical contact with the contact dome. A third terminal includes a gripping portion engaging the base and an extension spaced apart from the contact surface of the contact dome when said pushbutton is in an unactuated condition.

15 Claims, 22 Drawing Figures

38
34
32
30

42
40
30
35
36
44

50
54
32
44
30
46
48
52
56

62
86
90
60
32
78
6.
80
48
34
64
82
96
92
74
5.
5.
66
70
46
64a
72
44
6.
94
84
60a 42
72
74
66
134
34
76
70
36
32
64a
64
68
132
82a
60
88
46
108
106

MINIATURE TWO-LEVEL PUSHBUTTON SWITCH

BACKGROUND OF THE INVENTION

The present invention is directed generally to electrical switches, and more particularly to a miniature, two-level, low profile pushbutton switch for making at least one circuit at each of two levels of actuation thereof.

Such two-level switches are generally known. In many applications it is desirable to have a relatively low-travel switch which is nonetheless capable of making different circuits at different levels of travel thereof. Such switches are useful, for example, in conjunction with a camera having a self-contained metering system. In such applications, the first level of contact of such a switch is often utilized to actuate the metering system of the camera, and the second level thereof utilized to actuate the shutter of the camera for exposing a frame of film. In this application, the user may desire to check for proper exposure and hence actuate only the metering system without actually exposing a frame of film. Hence, depression of the switch only to its first level in order to observe a metering indicator may be desirable in many cases. Moreover, in many cameras the self-contained metering system also controls exposure time and hence shutter actuation. Accordingly, the metering system must remain energized during energization of the shutter. While such two-level pushbutton switches are not new, as such, there remains room for improvement. For example, many such switches heretofore in use, due to their relatively small size, have provided minimal internal contact surfaces for making the two circuits required, as described above. With such minimal contact surfaces, there is an increased danger of loss of electrical switching function due to wear or deformation of the parts over a period of service. While contact wear may cause an open circuit, excessive deformation of parts may cause a permanent short circuit in the switch. Both of the foregoing short circuit conditions prevent proper functioning of the switch and associated circuits.

Moreover, such switches must generally be provided in relatively large quantities at a competitive price, in order to be used on relatively inexpensive equipment, such as low-cost cameras. Accordingly, it is important to minimize the number of components utilized and yet maximize the ease with which these components may be assembled into a reliable low-cost switch.

OBJECTS AND SUMMARY OF THE INVENTION

Accordingly, it is a general object of the present invention to provide a new and improved miniature two-level low profile pushbutton switch.

A more specific object is to provide a switch of the foregoing type wherein contact surfaces are maximized for reliable electrical contact over a long service life.

A related object is to provide a switch of the foregoing type which utilizes relatively few and inexpensive parts and is relatively simple to assemble. Briefly, and in accordance with the foregoing objects, a miniature two-level pushbutton switch in accordance with the invention comprises a base portion for mounting a plurality of relatively movable electrical contacts and a plurality of relatively fixed electrical terminals, said base including at least one support surface for supporting said contacts and said terminals. A pushbutton is mounted to said base for reciprocal movement along a predetermined straight line. The relatively movable electrical contacts include an elongate contact bar mounted for movement in response to actuation of said pushbutton in a first direction and a contact dome comprising a broad, flat contact surface defining a first of said two levels of said switch and spaced apart from said contact bar when said pushbutton is in an unactuated condition, a peripheral rim portion seated on said base support surface and diverging side portions extending from said contact surface to said peripheral rim portion. The terminals include a first terminal in electrical contact with said contact bar, a second terminal in electrical contact with said contact dome and a third terminal spaced apart from said flat contact surface of said contact dome when said pushbutton is in an unactuated condition, said third terminal defining the second level of said two-level switch.

BRIEF DESCRIPTION OF THE DRAWINGS

The foregoing, as well as other objects, features and advantages of the invention will be more readily appreciated upon reading the following detailed description of the illustrated embodiment, together with reference to the accompanying drawings, wherein.

DETAILED DESCRIPTION OF THE ILLUSTRATED EMBODIMENT

Figure 1:
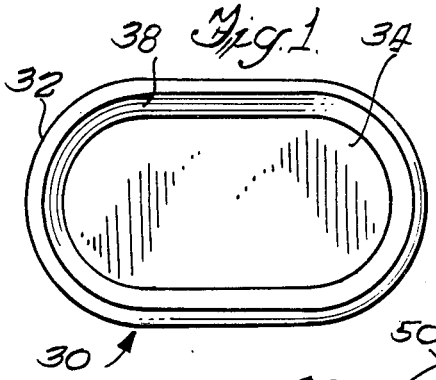
FIG. 1 is a top plan view of a miniature, two-level pushbutton switch in accordance with the invention.
Figure 2:
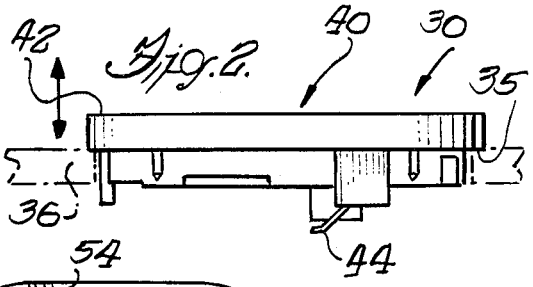
FIG. 2 is a side elevation of the switch of FIG. 1.
Figure 3:
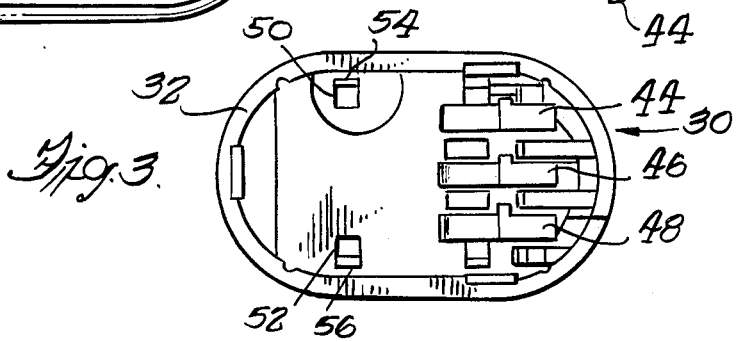
FIG. 3 is a bottom view of the switch of FIG. 1 and FIG. 2.

Referring now to the drawings and initially to FIGS. 1–3, there is seen a miniature, two-level pushbutton switch in accordance with the invention, designated generally by the reference numeral 30. This switch 30 includes a base portion 32 which receives a pushbutton number 34. In the illustrated embodiment, the base portion 32 includes a peripheral lip or shoulder portion 34 to facilitate mounting of the switch 30 through a suitable opening provided therefor in a mounting surface 36, shown in phantom line. Additionally, in the illustrated embodiment, the pushbutton 34 is mounted recessed within an internal shoulder portion 38 of the base 32 to present a relatively flat composite top surface, as indicated generally by the reference numeral 40 in FIG. 2.

As will be more fully described hereinbelow, the pushbutton 34 is mounted for reciprocal motion within the base 32, generally in the direction indicated by the arrow 42 in FIG. 2. In this regard the base 32 is provided with a number of through apertures, 50, 52, through which aligned gripping legs 54, 56 of the pushbutton 34 snappingly engage. As will be seen later, these legs 54, 56 are of sufficient length to permit the reciprocal motion of the pushbutton 34 in the direction 42. Generally speaking, this reciprocal motion of the pushbutton 34 is between a first position, generally in a flat or co-planar condition with the top surface of the base 32 to a second position, depressed below this level, as will be seen hereinbelow. Moreover, in the course of movement of the pushbutton 34 to the second, fully depressed state, at least two different circuits are completed. In order to carry these circuits externally of the switch 30, three terminals 44, 46 and 48 are provided. As best viewed in FIG. 3, these terminals 44, 46 and 48 extend outwardly of the bottom of the base portion 32 of the switch 30.

Figure 4:
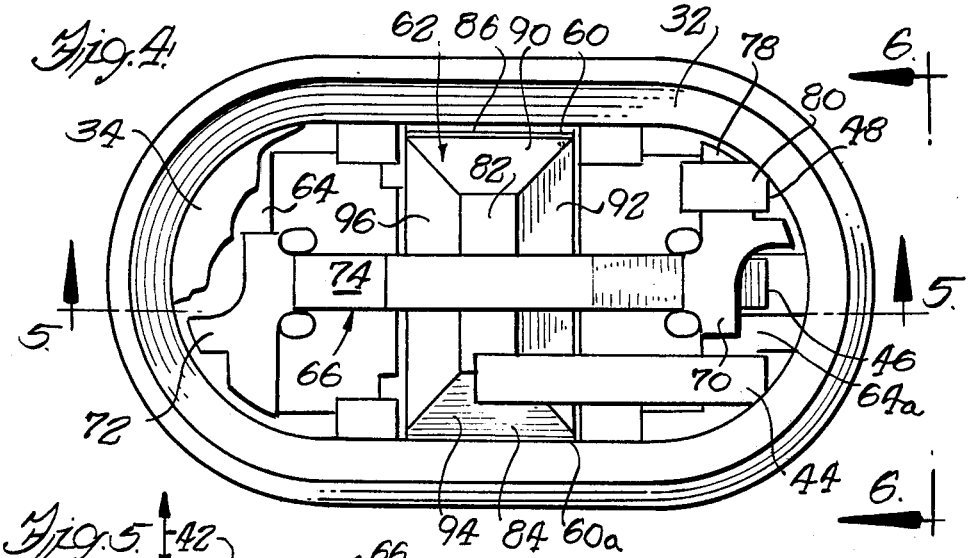
FIG. 4 is an enlarged, partially cut away top plan view of the pushbutton switch of the invention.
Figure 5:
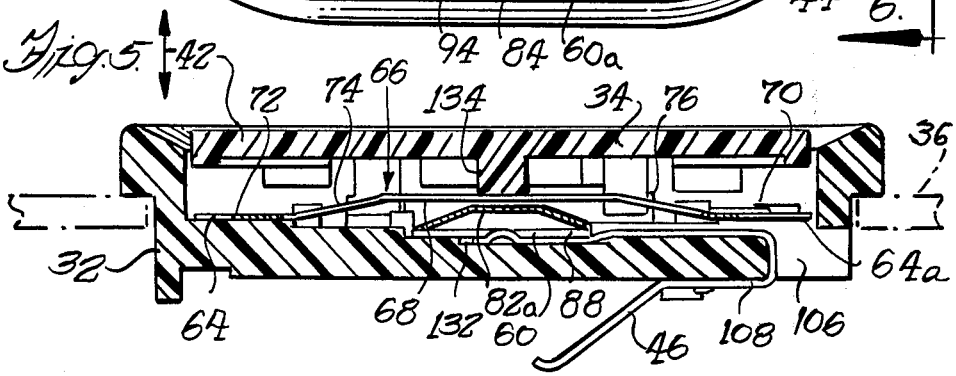
FIG. 5 is a sectional view taken generally along the line 5—5 of FIG. 4.

Reference is next invited to FIG. 4 and FIG. 5 wherein the operation of the switch 30 will be described with reference to the internal components thereof.

Figure 16:
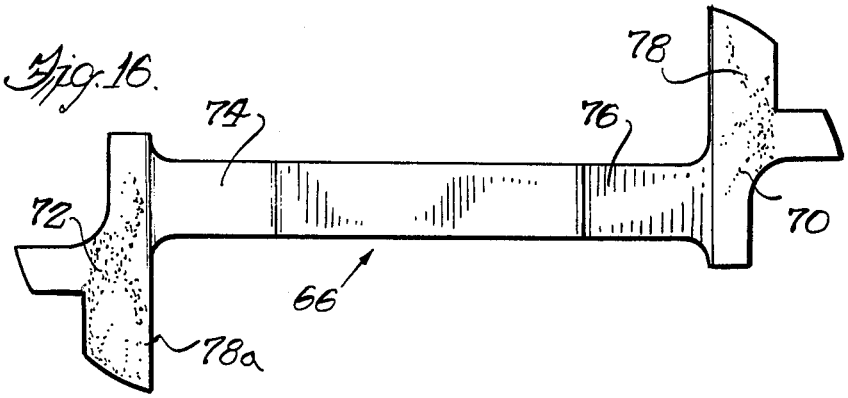
FIG. 16 is a top plan view of a contact bar member of the switch of FIGS. 1-6.
Figure 17:
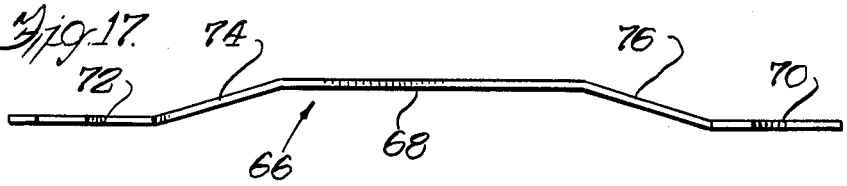
FIG. 17 is a side elevation of the contact bar of FIG. 16.
Figure 18:
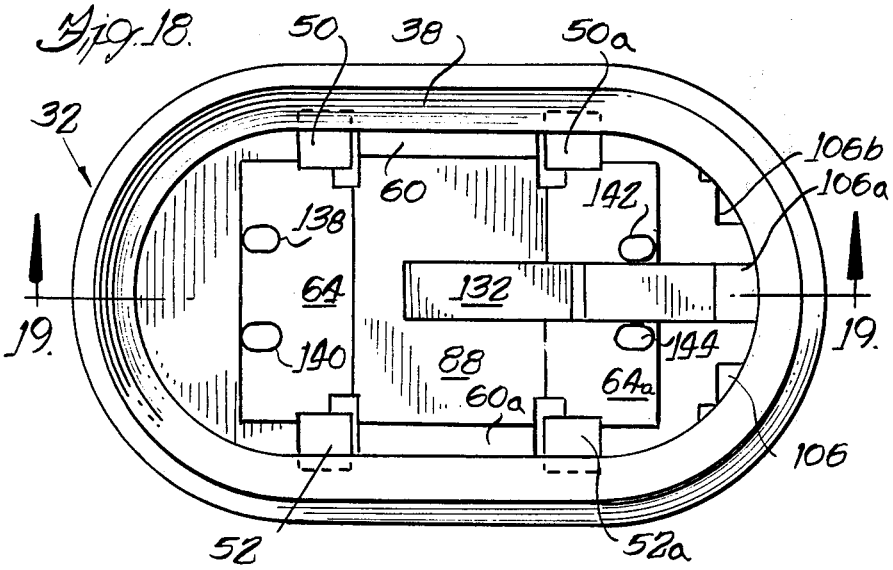
FIG. 18 is a top plan view of a base member of a switch of FIGS. 1-6.

As also shown in FIG. 18, the base 32 includes first support surfaces, 60, **60*a* supportably mounting a contact dome 62 and a second support surfaces 64, 64*a* for supportably mounting a contact bar 66. This contact bar 66, as also seen in FIGS. 16 and 17, comprises an elongate, relatively thin member of an electrically conductive metallic material. The contact surface 68 of the contact bar 66 is substantially centered with respect to the base 32. A central portion of this contact bar 66 defines a relatively broad, flat contact surface 68 and is preferably coated, plated or otherwise provided with a suitable durable contact grade material. The contact bar 66 also includes a pair of support surfaces 70, 72 formed generally at opposite ends thereof which are directly supported upon the support surfaces 64, 64*a* of the base 32. A pair of downwardly and outwardly diverging sides 74, 76 join the contact surface 68 with the respective support surfaces 70 and 72. Additionally, the support surface 72 has an outwardly extending contact portion 78, also preferably coated or otherwise provided with a suitable contact grade material. As will be seen later, this surface 78 is in electrical contact with a contact portion 80 of the terminal member 48**.

Figure 13:
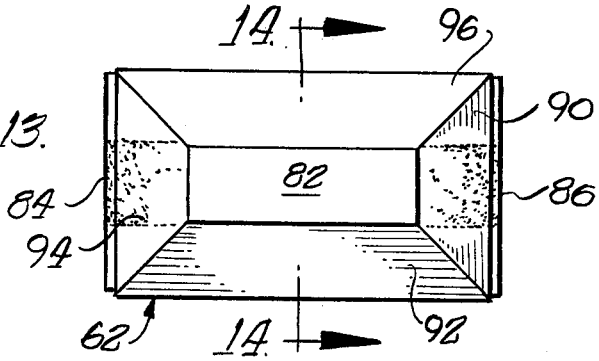
FIG. 13 is a top plan view of a contact dome member of the switch of FIGS. 1-6.
Figure 14:
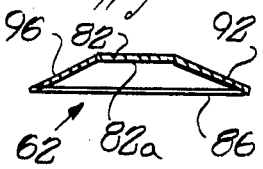
FIG. 14 is a sectional view taken generally on the line 14—14 of FIG. 13.
Figure 15:
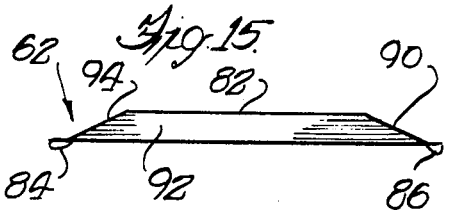
FIG. 15 is a side elevation of the contact dome of FIG. 13.

The contact dome 62, as also seen in FIGS. 13, 14 and 15, like the contact bar 66, is formed from a flat, thin sheet of an electrically conductive metallic material. This contact dome 62 includes a generally broad, flat contact surface 82 which, like the previously mentioned contact surface 68 of the contact bar 66, is preferably coated or otherwise provided with a suitable contact grade material. Additionally, as best viewed in FIG. 5, the rear side **82*a* of this contact surface 82** is also similarly coated or plated.

The contact dome 62 is further provided with peripheral rim portions 84, 86 at opposite lateral edges thereof which are seated upon the support portions 60, **60*a* provided therefor in the base 32. The contact surface 82 of the contact dome 62 is generally rectangular in configuration. Moreover, four downwardly and outwardly sloping or diverging side portions 90, 92, 94 and 96 join this contact surface 82 with the peripheral rims 84 and 86 and define the other two peripheral sides of the contact dome 62. It will be noted in this regard that the periphery of the contact dome 62 is generally rectangular; however, one pair of sides thereof are not supported by these support portions 60, 60*a* other than at the edges where they meet the supported rim portions 84, 86. Rather, as best viewed in FIG. 5, these sides are generally suspended over a well or depression 88 in the base 32 which will be more fully described hereinbelow. The contact surfaces 82, 82*a* are substantially centered with respect to the base 32**.

As mentioned above, the switch 30 is a two-level switch for accomplishing interconnection of at least two different circuits with a common circuit as the pushbutton 34 is depressed relative to the base 32. In this regard, in the illustrated embodiment, the terminal 48 will be hereinafter referred to as the common terminal. Similarly, the terminal 46 will be referred to as the B circuit terminal and the terminal 48 will be referred to as the A circuit terminal. To aid in understanding the following description of these terminals 44, 46 and 48 and their interaction with the parts thus far described, reference is also invited to FIGS. 7–12, inclusive, wherein these terminals 44, 46 and 48 are illustrated in additional detail.

Figure 6:
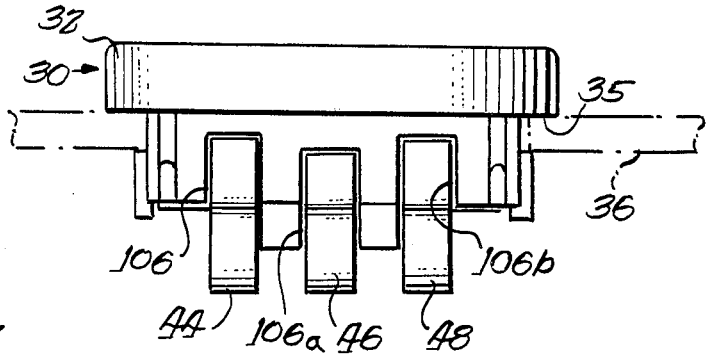
FIG. 6 is a side elevation taken generally along the line 6—6 of FIG. 4.
Figure 7:
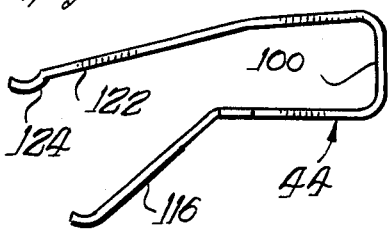
FIG. 7 is a side elevation of one terminal member of the switch of FIGS. 1-6.
Figure 8:
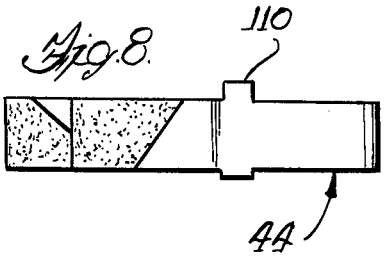
FIG. 8 is a bottom view of the terminal member of FIG. 7.
Figure 9:
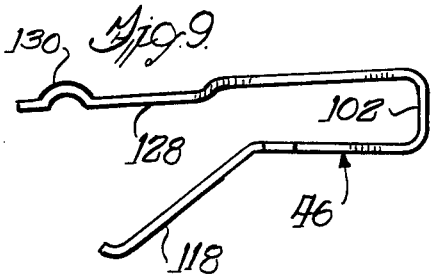
FIG. 9 is a side elevation of a second terminal member of the switch of FIGS. 1-6.
Figure 10:
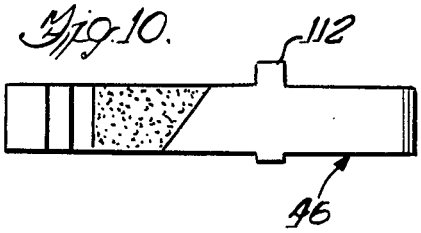
FIG. 10 is a bottom view of the terminal member of FIG. 9.
Figure 11:
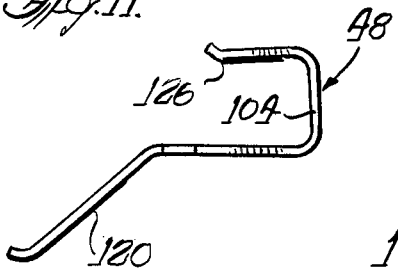
FIG. 11 is a side elevation of a third terminal member of the switch of FIGS. 1-6.
Figure 12:
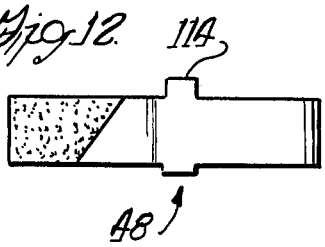
FIG. 12 is a bottom view of the terminal member of FIG. 11.

Each of these terminals 44, 46, 48 is formed from a flat, thin sheet of electrically conductive metallic material. Furthermore, each of these terminals 44, 46 and 48 includes a generally U-shaped clip portion 100, 102, 104 for grippingly engaging a lower edge part of the base 32. As best seen in FIG. 5, with respect to the terminal 46, a through opening or aperture 106 is provided for receiving the terminal 46, and the clip portion 102 thereof thereby grippingly engages a bottom surface portion 108 of the base 32. Similar through openings **106*a*, 106*b* (FIG. 6) and gripping engagement of a bottom surface portion of the base 32 are provided with respect to each of the other terminals 44 and 48. Additionally, each of the terminals 44, 46 and 48 is provided with suitable positioning projections 110, 112, 114 on the surfaces thereof which lie against the outer bottom surface of the base 32 and, as shown in FIG. 3, engage suitable positioning slots provided therefor in this bottom surface of the base 32**.

Each of these terminals 44, 46 and 48 includes an outwardly projecting connective part 116, 118 and 120 which projects away from the bottom surface of the base 32 to accommodate a suitable electrical connection, for example to a wire or other similar conductor. To this end, each of these projecting parts 116, 118 and 120 is provided with a suitable electrically conductive surface in the form of a coating or plating, or other suitable means to accommodate such a wire or other conductor, as by soldering.

The A circuit terminal 44 has an inwardly deformed extension 122, which carries at its outer end a further inwardly deformed part 124 which contacts the contact surface 82 of the contact dome 62. Preferably, this latter projection 124 is provided with a suitable contact grade surface by way of coating, plating or similar means where it contacts the surface 82 of the dome 62. Advantageously, the clip-shaped portion 100 and the inwardly deformed leg 122 cooperate to impart a spring-like nature to the terminal 44 to assure a firm electrical and mechanical contact between the projection 124 and contact surface 82. Advantageously, the clip portion 100 of the terminal 44, inwardly projecting or deformed leg 122 and the projection 124 also cooperate to hold the contact dome 62 in assembled condition with the base 32.

The common terminal 48 includes a relatively short inwardly projecting portion 126 which grippingly engages the laterally projecting contact surface 78 of the contact bar 66. To ensure good electrical contact therebetween, this projecting portion 126 of the terminal 48 is also provided with a suitable electrical contact grade surface by way of coating, plating or other suitable means. Advantageously, the U-shaped clip portion 104 and inwardly deformed or projecting leg 126 of the common terminal 48 also serves to hold the contact bar 66 in assembled condition with the base 32.

The B circuit contact 46 has an inwardly deformed extension 128 which projects inwardly of the base 106 from the gripping engagement of the clip portion 102 thereof with the bottom portion 108 of the base 32. This inwardly projecting extension 128 terminates in an upwardly projecting contact surface 130 which is provided with an electrical contact grade surface by way of coating, plating or a similar means, in the same fashion as the above-described contact surfaces. This latter contact surface or projection 130 and the supporting leg 128 thereof are positioned in an elongate recess 132 provided therefor in the base 32. Advantageously, this recess 132, and hence the contact projection 130 are substantially centered below the contact dome 62.

Figure 20:
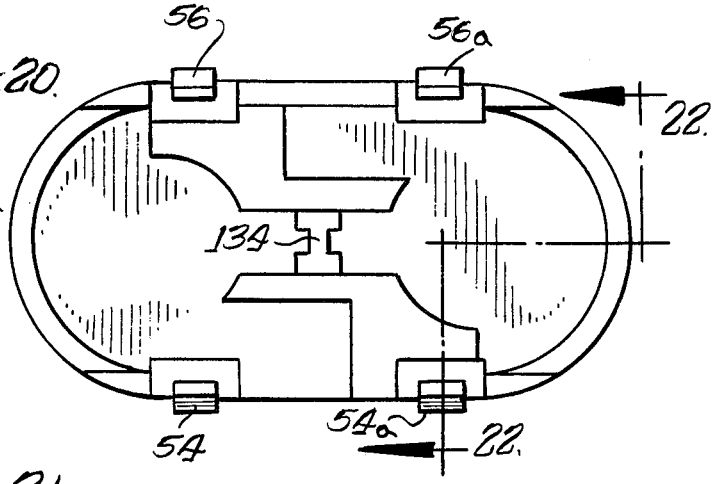
FIG. 20 is a bottom view of a pushbutton member of the switch of FIGS. 1-6.
Figure 21:
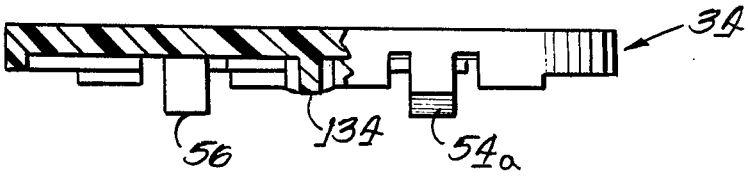
FIG. 21 is a side elevation, partially in section, of the pushbutton of FIG. 20.
Figure 22:
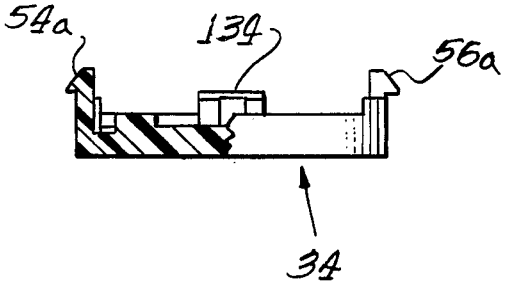
FIG. 22 is a view, partially in section, taken generally along the line 22—22 of FIG. 20.

Referring again to FIG. 5, and as also shown in FIGS. 20, 21 and 22, the pushbutton 34 includes an inwardly projecting abutment surface or actuating member 134 which is substantially centered thereon and hence also substantially centered with respect to the elongate contact bar 66 and the contact dome 62, respectively.

In operation, when the push button 34 is at rest, that is, in an unactuated condition, with substantially no downward force applied thereto, the actuating or abutment surface 134 rests upon a central portion of the contact bar 66. However, it will be noted that the contact surface 82 of the contact dome 62 is spaced apart by a relatively short distance from the contact surface 68 of the contact bar 66. Accordingly, a relatively light amount of downward force applied to the pushbutton 34 will cause sufficient downward deformation of the contact bar 66 to achieve electrical contact between the respective contact surfaces 68 and 82.

When this electrical contact is made, a circuit is completed from the common terminal 48 by way of the contact bar 66 and contact dome 62, to the A circuit terminal 44. Advantageously, the relative broad contact surfaces 68 and 82 of the respective contact bar 66 and contact dome 62 ensure a relatively large surface-to-surface contact therebetween, and thereby enhance the reliability of this "first level" function of the pushbutton switch 30. Moreover, it will be recognized in this regard that the undeformed position of the contact dome 62, as viewed in FIG. 5, essentially defines this first level of the two-level switch 30. If the actuating force is released from the pushbutton 34, the spring-like nature of the contact bar 66 will cause the pushbutton 34 to return to its undepressed condition, as viewed in FIG. 5, breaking the "common-to-A" circuit.

If an additional or greater amount of downward force is applied for depressing the pushbutton 34, the abutment surface 134 thereof will deform the contact bar 66 to achieve the first level circuit connection mentioned above and thereafter continue downwardly to depress and downwardly deform the contact dome 62. It will be remembered in this regard that the contact dome 62 is supported primarily at the rims or edges 84, 86 thereof. Consequently, continued downward pressure upon the pushbutton 34 will cause the contact dome to buckle inwardly along the longer sides thereof, until the bottom contact surface **82*a* thereof achieves electrically conductive contact with the projection or contact surface 130 of the B circuit terminal 46 therebelow. In this condition, an electrical circuit is completed from the common terminal 48 by way of the contact bar 66 and the contact dome 62 to the B circuit terminal 46. In the illustrated embodiment, it will also be noted that the spring-like nature of the terminal 44 and in particular the downwardly projecting portion 122 thereof is such that the A circuit, that is from the common terminal 48 to the A circuit terminal 46, also remains completed when the B circuit has been completed due to full depression of the pushbutton 34. In this regard, it will be noted that the outer edge of the contact dome 62 and hence contact surface 82 thereof will not be deformed or depressed inwardly to the same extent as the central portion thereof immediately below the centered abutment or actuating surface 134 of the pushbutton 34. Accordingly, the projection 124 of the terminal 44 will remain in electrically conductive contact with the contact surface 82 of the contact dome 62 at all times, without regard for the position of the pushbutton 34** and other components.

Referring briefly to FIG. 16, it will be seen that the contact bar 66 has a symmetrical form, having another outwardly extending contact part **78*a* at the opposite end thereof. Advantageously, this aids in assembly of the switch 30, since the contact bar 66 may thus be placed in either orientation with respect to the base 32**.

Further in this regard, and referring briefly to FIG. 18, the base 32 also includes four upstanding bosses 138, 140, 142 and 144 to aid in positioning the contact bar 66 therein. Also with reference to FIG. 18, it will be seen that the through apertures 50, 52 are complemented by additional, symmetrically formed through apertures **50*a* and 52*a* for receiving mounting legs 54*a*, 56*a* of the pushbutton 34, shown in FIG. 20**.

From the foregoing, it will be seen that a relatively low profile, low travel, two-level switch is provided. In this regard, it will be noted that the pushbutton 34, and in particular the actuating portion 134 thereof, the contact surface 68 of the contact bar 66 and the contact surfaces 82, **82*a* of the contact dome 62 lie in parallel planes when the pushbutton 34 is in its unactuated condition. Moreover, the actuation or abutment surface 134** of the pushbutton 34 presents a relatively large surface area to the contact surface 68 of the contact bar 66. Similarly, the contact surface 68 of the contact bar 66 presents a relatively large surface area to the facing contact surface 82 of the contact dome 62. These latter contact surfaces are relatively closely spaced when the pushbutton 34 is in its unactuated condition. Hence, a relatively small amount of force, resulting in a relatively small amount of travel will achieve sufficient deformation of the contact bar 66 to achieve reliable electrical contact between these contact surfaces 68 and 82 to make the first or A circuit.

An additional amount of force applied to the pushbutton 34 will cause further downward deformation of the central portion of the contact dome 62 to achieve electrical contact with the B circuit terminal 44, thus completing the second level or B circuit of the two-level switch of the invention. It will be noted that the distance or amount of travel to achieve both of these levels or circuits is quite small compared to the transverse dimensions of the switch 30, to thereby provide a relatively low profile or low travel switch. Additionally, the provision of the shoulder portions 35 permits recessing of a substantial portion of the switch with respect to a mounting surface 36, thereby further enhancing this low profile when the switch is installed in the mounting surface 36.

Figure 19:
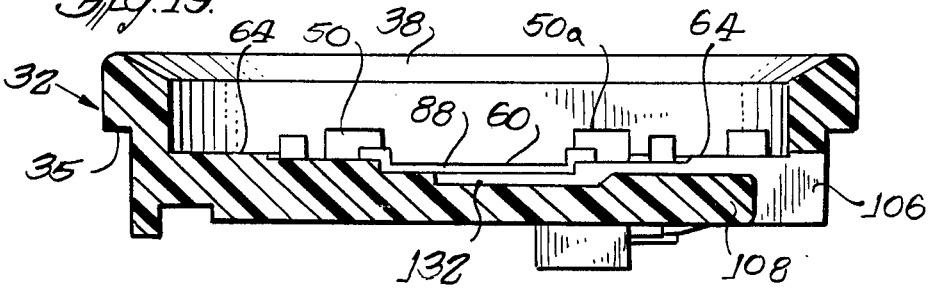
FIG. 19 is a sectional view taken generally along the line 19—19 of FIG. 18.

As described above, assembly of the switch 30 in accordance with the invention is also greatly simplified by the provision of the contact bar 66, as illustrated in FIG. 16, such that it may be installed in either orientation relative to the base 32. Additionally, the positioning bosses 138, 140, 142 and 144 aid in properly positioning the contact bar 66. As also described above, the common terminal 48 and in particular the contact portion 80 thereof serves to hold the contact bar 66 in position upon the base 32 when the terminal 48 is assembled therewith. In similar fashion, and with particular reference to FIG. 19, it will be noted that the support surfaces 60, 60*a* are somewhat recessed to encourage proper positioning of the contact dome 62 with respect to the base 32. Additionally, the symmetrical shape of this contact dome 62 permits proper installation thereof in either orientation with respect to the support surfaces 60, 60*a*. The terminal 44, as mentioned above, achieves not only electrical contact with the contact dome 62, but also, due to the spring-like nature of the extension 122, serves to hold the contact dome 62 in position with respect to the base, throughout its range of movement.

What has been illustrated and described herein is a novel and improved miniature, two-level low profile pushbutton switch. While the invention has been described with reference to a preferred embodiment, the invention is not limited thereto. Those skilled in the art may devise various alternatives, changes and modifications upon reading the foregoing description. The invention includes such changes, alternatives and modifications insofar as they fall within the spirit and scope of the appended claims.

The invention is claimed as follows:

1. A miniature, two-level pushbutton switch comprising: a base portion for mounting a plurality of movable electrical contacts and a plurality of fixed electrical terminals, said base including at least one support surface for supporting said contacts and terminals, and a pushbutton mounted to said base for reciprocal movement along a predetermined straight line, wherein said plurality of movable electrical contacts includes an elongate contact bar having at least one contact surface mounted for movement in response to actuation of said pushbutton in a first direction and a contact dome comprising a broad contact surface defining a first of said two levels of said switch and spaced apart from said contact surface of said contact bar when said pushbutton is in an unactuated condition, a peripheral rim portion supported on said support surface of said base and diverging sides extending at least from said broad contact surface to said peripheral rim portion, and wherein said plurality of terminals includes a first terminal in electrical contact with said contact bar, a second terminal in electrical contact with said contact dome and a third terminal spaced apart from said contact surface of said contact dome at least when said pushbutton is in an unactuated condition, said third terminal defining a second level of said two-level pushbutton switch.

2. A switch according to claim 1 wherein said base has a pair of spaced apart second support surfaces and wherein said contact surfaces of said contact dome and of said contact bar comprise broad, flat contact surfaces, a pair of end support portions respectively supported on said second support surfaces and a pair of side portions diverging from said contact surface to said support portions, substantial portions of said flat contact surfaces of said contact bar and of said contact dome, respectively, being in electrical contact when said pushbutton is depressed at least a predetermined distance, said predetermined distance being greater than the spacing between the respective contact surfaces when said pushbutton is in an unactuated condition.

3. A switch according to claim 2 wherein said contact bar comprises an elastically deformable, spring-like member whereby a first predetermined amount of force applied to said pushbutton will result in a first predetermined amount of movement of said contact bar for achieving electrical contact between the respective flat contact surfaces of said contact bar and said contact dome, thereby making an electrical circuit between said first terminal and said second terminal.

4. A switch according to claim 3 wherein said contact dome comprises an elastically deformable spring-like member whereby a second predetermined amount of force applied to said pushbutton, in excess of said first predetermined amount of force, will cause a predetermined additional amount of movement of said contact bar and of said contact dome to achieve a further electrical contact between said contact dome and said third terminal and thereby making a second electrical circuit between said first terminal and said third terminal.

5. A switch according to claim 4 wherein said flat contact surface of said contact dome is substantially rectangular in form and said diverging sides are four in number, one extending from each edge of said rectangular contact surface, and wherein said peripheral rim portion supports only one opposing pair of said four diverging sides, whereby said second predetermined amount of force is substantially greater than said first predetermined amount of force, so as to provide a positive tactile feedback upon achieving said second switch level.

6. A switch according to claim 4 wherein said predetermined amounts of movement are substantially less than the transverse dimensions of said pushbutton switch, whereby said pushbutton switch presents a relatively low profile.

7. A switch according to claim 2 wherein said contact bar includes a second contact surface extending laterally outwardly of at least one support portion thereof and wherein said first terminal includes a deformed end portion for grippingly engaging said laterally extending contact portion against said base support portion simultaneously with achieving electrical contact therewith.

8. A switch according to claim 7 wherein said second terminal includes an outwardly extending portion for urging said contact dome against said base support portion while at the same time achieving electrical contact with said contact dome, without causing deformation thereof.

9. A switch according to claim 8 wherein said third terminal includes an outwardly extending portion underlying said contact dome.

10. A switch according to claim 9 wherein said first, second and third terminals are all grippingly engaged with said base portion, thereby holding said contact bar, said contact dome and said terminals in assembled relation with said base.

11. A switch according to claim 1 wherein said contact surfaces of said contact bar and said contact dome, respectively, and said pushbutton are located in parallel planes when said pushbutton is in an unactuated condition, said parallel planes being substantially normal to the direction of movement of said pushbutton.

12. A miniature, two-level pushbutton switch comprising: a base for mounting a plurality of relatively movable electrical contacts and a plurality of relatively fixed electrical terminals, said base including at least one support surface for supporting said contacts and said terminals, and a pushbutton mounted to said base for reciprocal movement along a predetermined straight line, wherein said plurality of relatively movable electrical contacts includes an elongate contact bar having at least one contact surface mounted for movement in response to actuation of said pushbutton in a first direction and a contact dome having at least one contact surface normally spaced apart from said contact surface of said contact bar when said pushbutton is in an unactuated condition, and wherein said plurality of terminals includes a first terminal including means for grippingly engaging a predetermined part of said contact bar and a predetermined part of said support surface, thereby holding said contact bar in assembled condition with said base while achieving electrical contact between said terminal and said contact bar, a second terminal including means for grippingly engaging a predetermined portion of said base and means for urging said contact dome against said support surface, thereby holding said contact dome in assembled condition with said base while achieving electrical contact between said second terminal and said contact dome, and a third terminal including means for grippingly engaging a predetermined portion of said base and an extension spaced apart from said contact surface of said contact dome when said pushbutton is in an unactuated condition.

13. A switch according to claim 12 wherein said contact dome comprises a broad, flat contact surface defining a first of the two levels of said pushbutton switch, a pair of rim portions supported on said support surface of said base and diverging sides extending from said flat contact surface to said rim portions, and wherein said contact bar includes a broad, flat contact surface, a pair of end support portions respectively supported on said support surface and a pair of side portions diverging from said contact surface to said support portions, substantial portions of said flat contact surfaces of said contact bar and of said contact dome, respectively, being in electrical contact when said pushbutton is depressed at least a predetermined distance.

14. A switch according to claim 12 wherein said flat contact surfaces of said contact bar and said contact dome, respectively, and said pushbutton are located in parallel planes when said pushbutton is in an unactuated position, said parallel planes being substantially normal to the direction of movement of said pushbutton.

15. A miniature, two-level pushbutton switch comprising: a base for mounting a plurality of relatively movable electrical contacts and a plurality of relatively fixed electrical terminals, and a pushbutton mounted to said base for reciprocal movement along a predetermined straight line, wherein said plurality of movable electrical contacts includes a contact bar having at least one relatively flat contact surface mounted for movement in response to actuation of said pushbutton in a first direction and a contact dome having at least one flat contact surface spaced apart from said contact surface of said contact bar, and wherein said plurality of terminals includes a first terminal in electrical contact with said contact bar, a second terminal in electrical contact with said contact dome and a third terminal spaced apart from said flat contact surface of said contact dome at a side thereof opposite said contact bar, and wherein the spacing between said flat contact surfaces of said contact bar and said contact dome and the spacing between said flat contact surface of said contact dome and said third terminal are together substantially smaller than the transverse dimensions of said pushbutton switch, to define a relatively low profile, low travel switch.

* * * * *